US009828763B2

(12) United States Patent
Hohmann, Jr.

(10) Patent No.: US 9,828,763 B2
(45) Date of Patent: Nov. 28, 2017

(54) WALL ANCHOR WITH HOLLOW BODY

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 14/959,953

(22) Filed: Dec. 4, 2015

(65) Prior Publication Data

US 2017/0159286 A1 Jun. 8, 2017

(51) Int. Cl.
*E04B 1/41* (2006.01)

(52) U.S. Cl.
CPC .... *E04B 1/4185* (2013.01); *E04B 2001/4192* (2013.01)

(58) Field of Classification Search
CPC ..... E04B 1/4185; E04B 2001/4192
See application file for complete search history.

(56) References Cited

U.S. PATENT DOCUMENTS 1,293,391 A * 2/1919 Ewing ..... E04G 17/0721 249/214
5,243,805 A * 9/1993 Fricker ..... E04B 1/41 52/698
5,408,798 A * 4/1995 Hohmann ..... E04B 1/4185 52/562
5,454,200 A * 10/1995 Hohmann ..... E04C 5/16 52/379
7,309,199 B2 * 12/2007 Ayrle ..... C04B 28/24 411/258
7,404,274 B2 * 7/2008 Hayes ..... E04B 1/4185 405/259.5
8,857,122 B2 * 10/2014 Wathne ..... E04B 1/38 405/259.5
8,978,326 B2 * 3/2015 Hohmann, Jr. ..... E04H 9/02 52/238.1
9,388,591 B2 * 7/2016 Wathne ..... E04B 1/38
2003/0206774 A1 * 11/2003 Dierker ..... E21D 20/025 405/259.2
2005/0097849 A1 * 5/2005 Hayes ..... E04B 1/4185 52/698
2008/0148664 A1 * 6/2008 Hayes ..... E04B 1/4185 52/379
2012/0317920 A1 * 12/2012 Wathne ..... E04B 1/38 52/699
2014/0202098 A1 * 7/2014 De Smet ..... E04B 1/4178 52/309.16
2014/0260065 A1 * 9/2014 Hohmann, Jr. ..... E04B 1/4114 52/704
2015/0007526 A1 * 1/2015 Wathne ..... E04B 1/38 52/745.21

* cited by examiner

*Primary Examiner* — Rodney Mintz
(74) *Attorney, Agent, or Firm* — Senniger Powers LLP

(57) ABSTRACT

A wall anchor for use in a cavity wall to connect to a veneer tie to join an inner wythe and an outer wythe of the cavity wall includes a hollow body having a wall defining a hollow interior. The hollow body includes a receptor located on the wall and configured to connect to an attachment portion of a veneer tie in a relation so as to transmit forces between the inner wythe and the outer wythe.

15 Claims, 20 Drawing Sheets

WALL ANCHOR WITH HOLLOW BODY

FIELD OF THE INVENTION

The present invention generally relates to anchoring systems for insulated cavity walls, and more specifically, a wall anchor with a hollow body that reduces thermal transfer in a cavity wall.

BACKGROUND

Anchoring systems for cavity walls are used to secure veneer facings to a building and overcome seismic and other forces (e.g., wind shear, etc.). Anchoring systems generally form a conductive bridge or thermal pathway between the cavity and the interior of the building through metal-to-metal contact. When the exterior is cold relative to the interior of a heated structure, heat from the interior should be prevented from passing through to the outside. Similarly, when the exterior is hot relative to the interior of an air conditioned structure, heat from the exterior should be prevented from passing through to the interior.

SUMMARY

In one aspect, a wall anchor for use in a cavity wall to connect to a veneer tie to join an inner wythe and an outer wythe of the cavity wall includes a hollow body having a wall defining a hollow interior. The hollow body includes a receptor located on the wall and configured to connect to an attachment portion of a veneer tie in a relation so as to transmit forces between the inner wythe and the outer wythe.

In another aspect, an anchoring system for use in a cavity wall having an inner wythe and an outer wythe spaced from the inner wythe and forming a cavity therebetween includes a wall reinforcement configured to be received in the inner wythe. The wall reinforcement includes first and second parallel side wires and at least one intermediate wire extending between the first and second side wires. A wall anchor is attached to at least one of the first side wire and the intermediate wire. The wall anchor includes a hollow body having a wall defining a hollow interior. The hollow body extends from a first end attached to the wall reinforcement to a second end configured to extend into the cavity of the cavity wall. The hollow body includes a receptor located on the wall adjacent the second end and configured to receive an attachment portion of a veneer tie in a relation so as to transmit forces between the inner wythe and the outer wythe.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
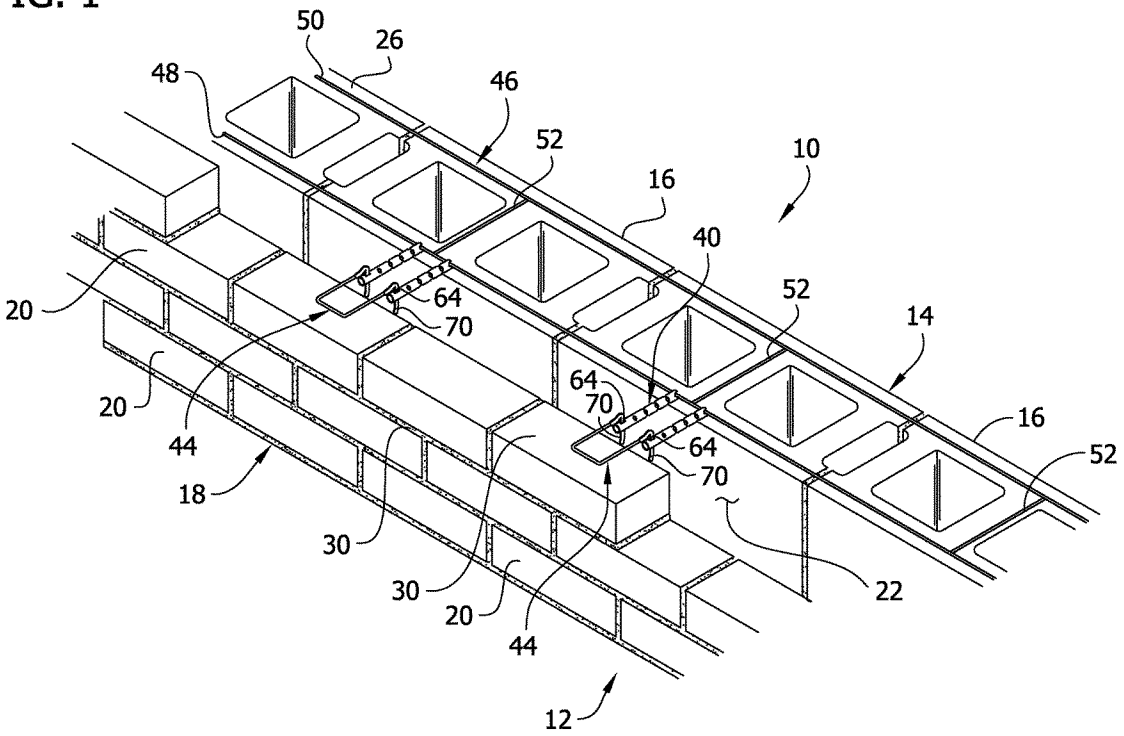
FIG. 1 is a perspective of a first embodiment of an anchoring system installed on a cavity wall structure.

Referring to FIG. 1, an embodiment of an anchoring system for cavity walls is shown generally at 10. A cavity wall structure generally indicated at 12 comprises an inner wythe or backup wall 14 of masonry block 16 and an outer wythe or facing wall 18 of brick 20 construction. Between the inner wythe 14 and the outer wythe 18, a cavity 22 is formed. An air/vapor barrier and/or insulation can be attached to an exterior surface of the inner wythe 14 (not shown). It is to be understood that the inner and outer wythes may have other constructions than described herein within the scope of the present invention.

Successive bed joints 26 are formed between courses of blocks 16 and are substantially planar and horizontally disposed. In addition, successive bed joints 30 are formed between courses of bricks 20 and are substantially planar and horizontally disposed. In accordance with building standards, the bed joints are approximately 0.375 inches (0.9525 cm) in height in a typical embodiment. Selective ones of bed joints 26 receive a wall reinforcement 46. Selective ones of bed joints 30 receive the insertion portion of a veneer tie 44. A wall anchor 40 extends into the cavity 22 and is attached to the wall reinforcement 46 in a suitable manner, such as by welding. It is also contemplated that the wall anchor could be formed as one piece with the reinforcement. It is understood that the described and illustrated wall structure 12 is exemplary only. Other structures may be used without departing from the scope of the present invention. As described in greater detail below, the wall anchor 40 is constructed and configured to reduce thermal transfer between the wall anchor and a veneer tie 44 attached to the wall anchor.

The wall reinforcement 46 includes parallel side wire members 48, 50 and intermediate wires 52 extending between and interconnecting the side wires. As illustrated in FIG. 1, the intermediate wires 52 of the wall reinforcement 46 form a ladder formation, although other configurations (such as a truss formation) are within the scope of the present invention. At intervals along the wall reinforcement 46, wall anchors 40 extend from the wall reinforcement and into the cavity 22. Each wall anchor 40 includes a receptor portion for receiving the veneer tie 44, as described in further detail below. The wall anchor 40 and the wall reinforcement 46 can be made of any suitable material. In one embodiment, the wall anchor 40 is made of stainless steel. In one embodiment, the wall reinforcement 46 is made of stainless steel. Other materials, such as galvanized steel, aluminum, or plastic, are within the scope of the present invention. The wall anchor 40 and the wall reinforcement 46 can be made of the same material or can be made of different materials.

Figure 2:
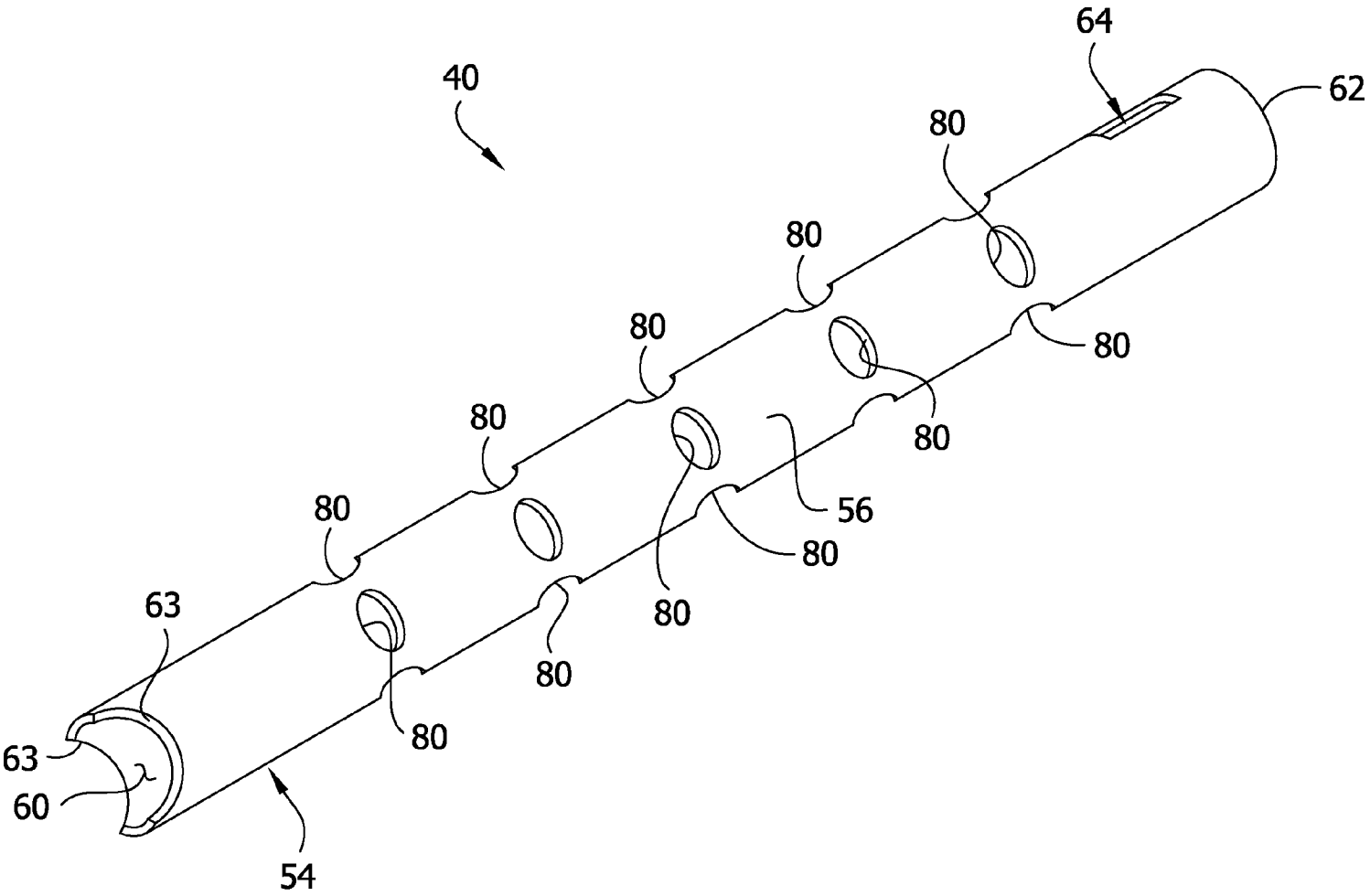
FIG. 2 is a front perspective of a first embodiment of a wall anchor of the anchoring system.
Figure 6:
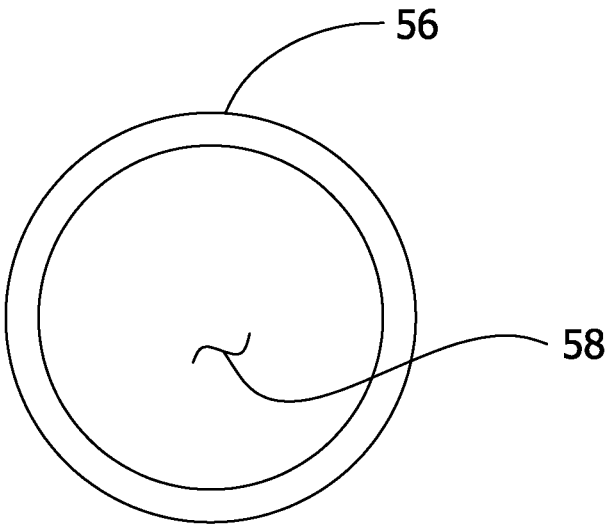
FIG. 6 is a front view of the wall anchor.
Figure 10:
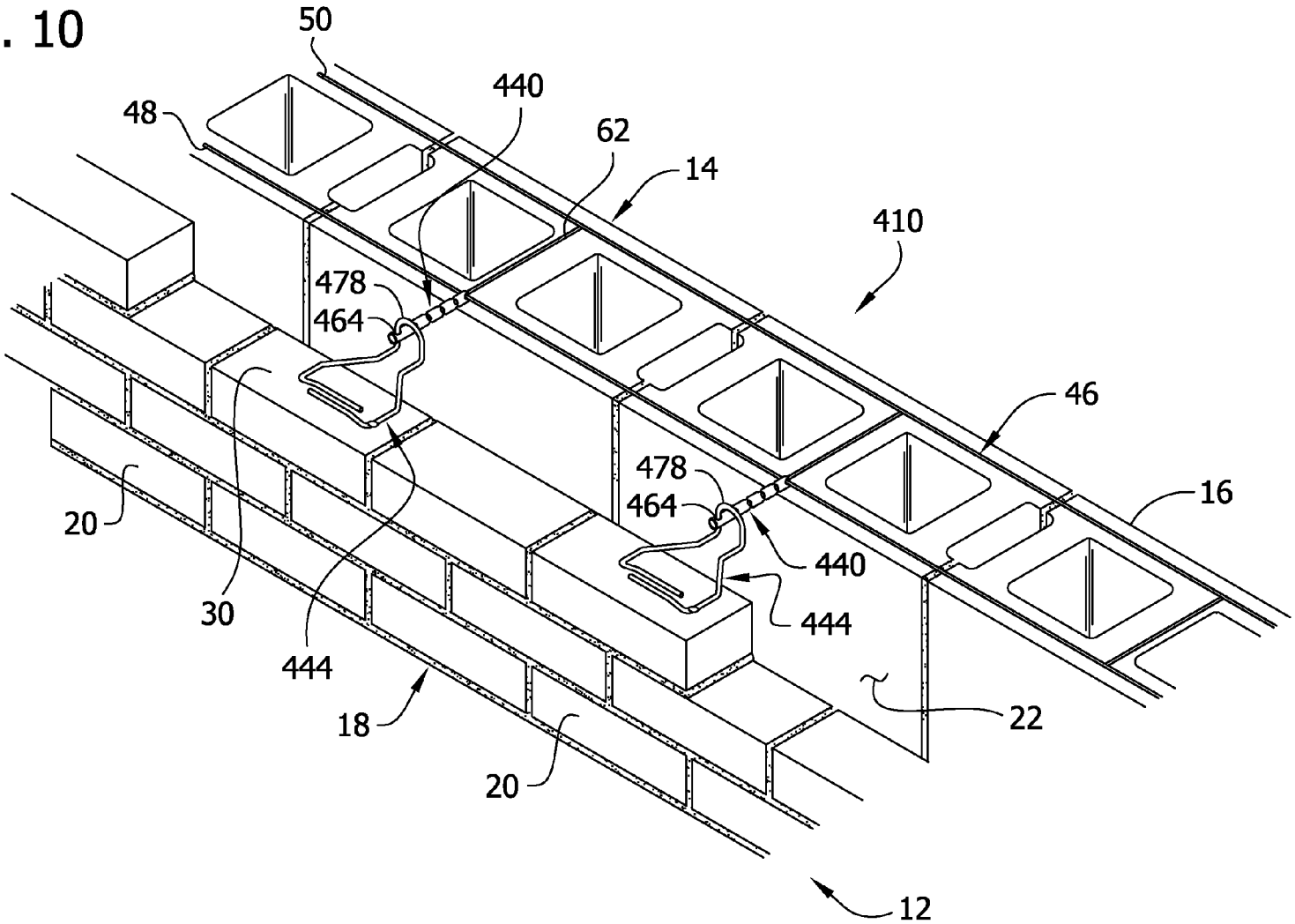
FIG. 10 is a perspective of a second embodiment of an anchoring system installed on a cavity wall structure.

Referring to FIGS. 2-6, the wall anchor 40 includes a hollow body 54. In the illustrated embodiment, the hollow body 54 is generally cylindrical, although other shapes (e.g., rectangular) are within the scope of the present invention. The hollow body 54 includes a wall 56 defining a hollow interior 58 of the hollow body (FIG. 6). The wall 56 extends from a first open end 60 to a second open end 62 of the hollow body 54. The first open end 60 is configured for attachment to the wall reinforcement 46 in a suitable manner. In the illustrated embodiments, the first open end 60 is welded to the side wire member 48 (FIG. 1), or welded to the side wire member and the intermediate wire (FIG. 10). When the first open end 60 is attached to the wall reinforcement 46, the second open end 62 extends into the cavity 22. The first open end 60 is cut back on its sides to form semi-circular recesses 63 for receiving the side wire member 48. As illustrated in FIG. 2, the first open end 60 includes two semi-circular recesses 63. The recesses 63 provide for a more nearly conformal engagement with the round side wire member 48, thereby enhancing the weld connection between the wall anchor 40 and the wall reinforcement 46. It is understood that other configurations are within the scope of the present invention. For example, the first end 60, the second end 62, or both the first and second ends of the hollow body 54 may be closed ends. In one embodiment, the first open end can include additional recesses (e.g., four recesses, see FIGS. 17 and 18).

Figure 3:
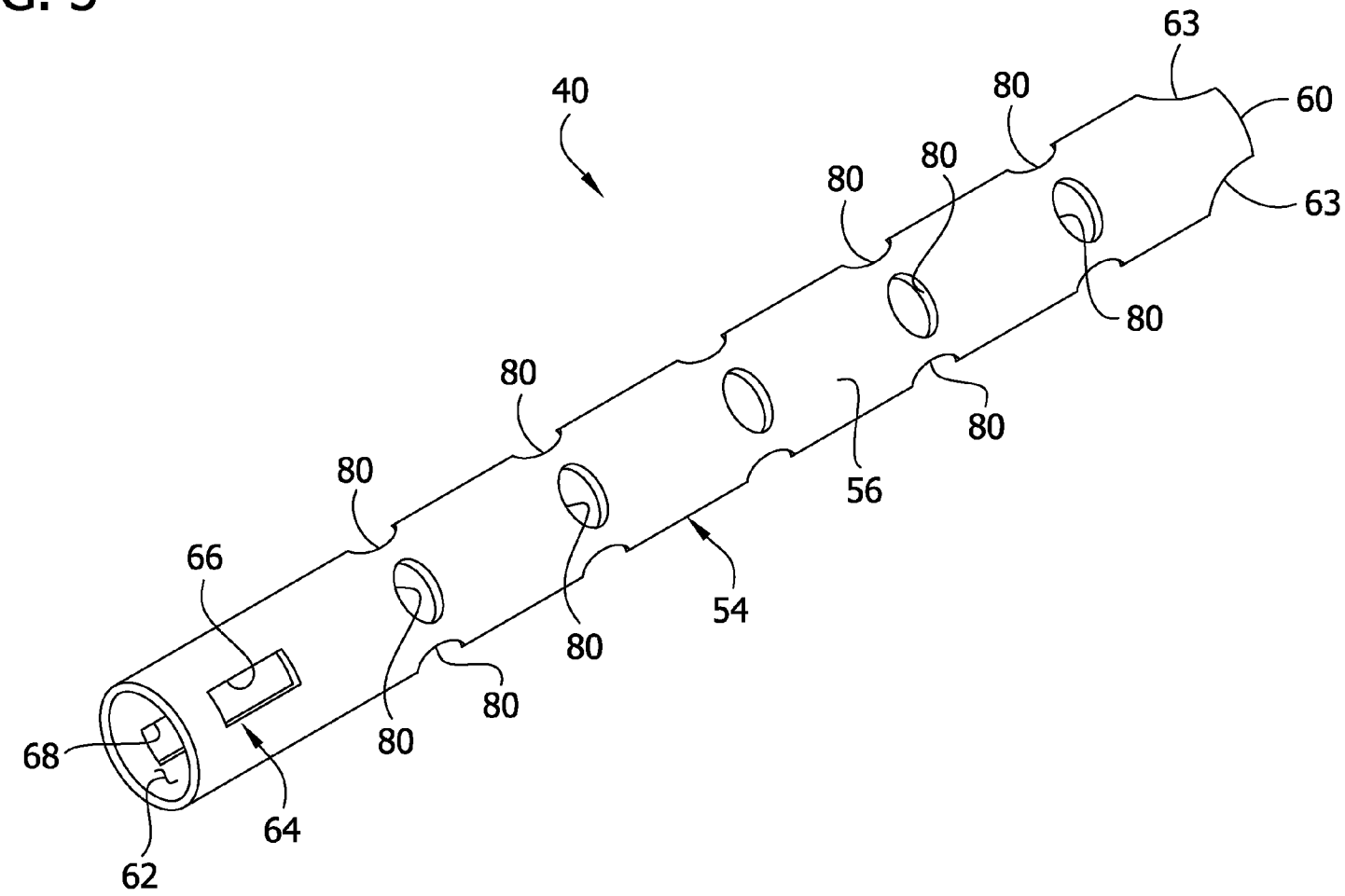
FIG. 3 is a rear perspective thereof.
Figure 4:
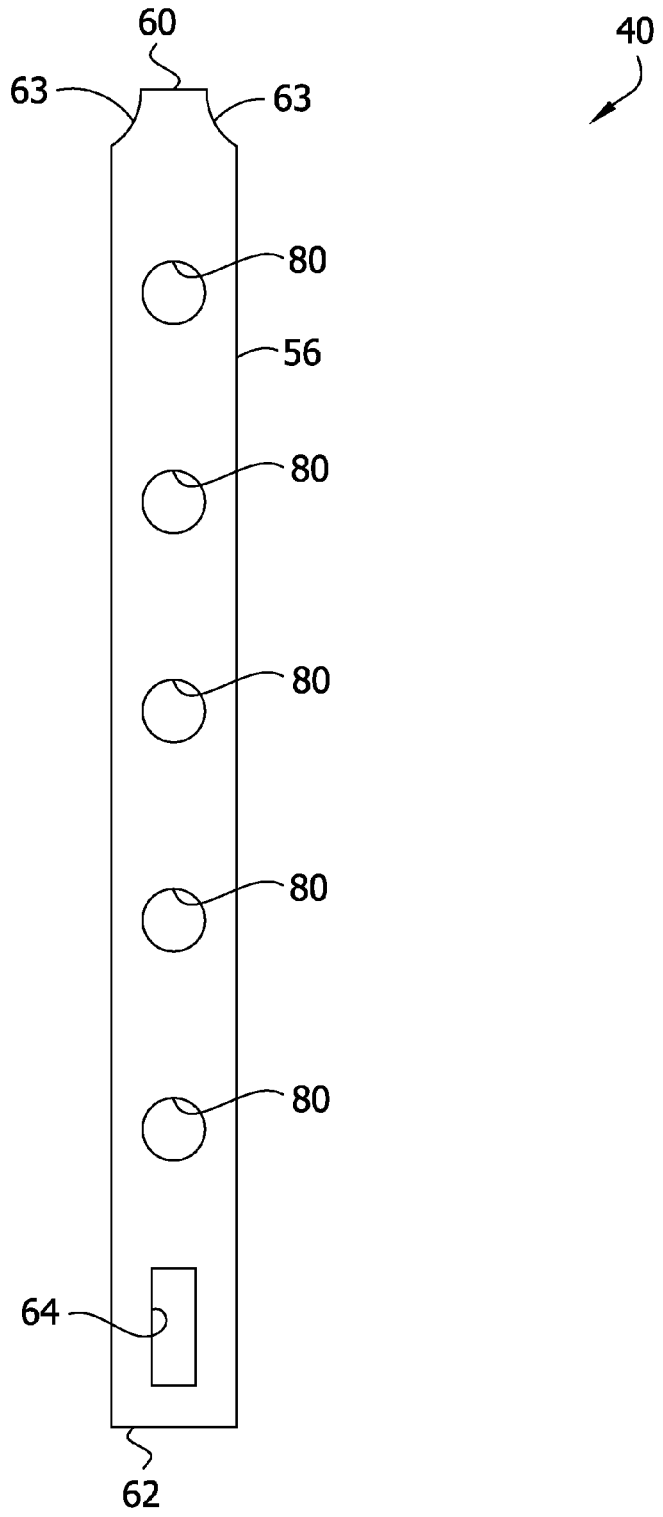
FIG. 4 is a top view of the wall anchor, the bottom view being identical thereto.
Figure 5:
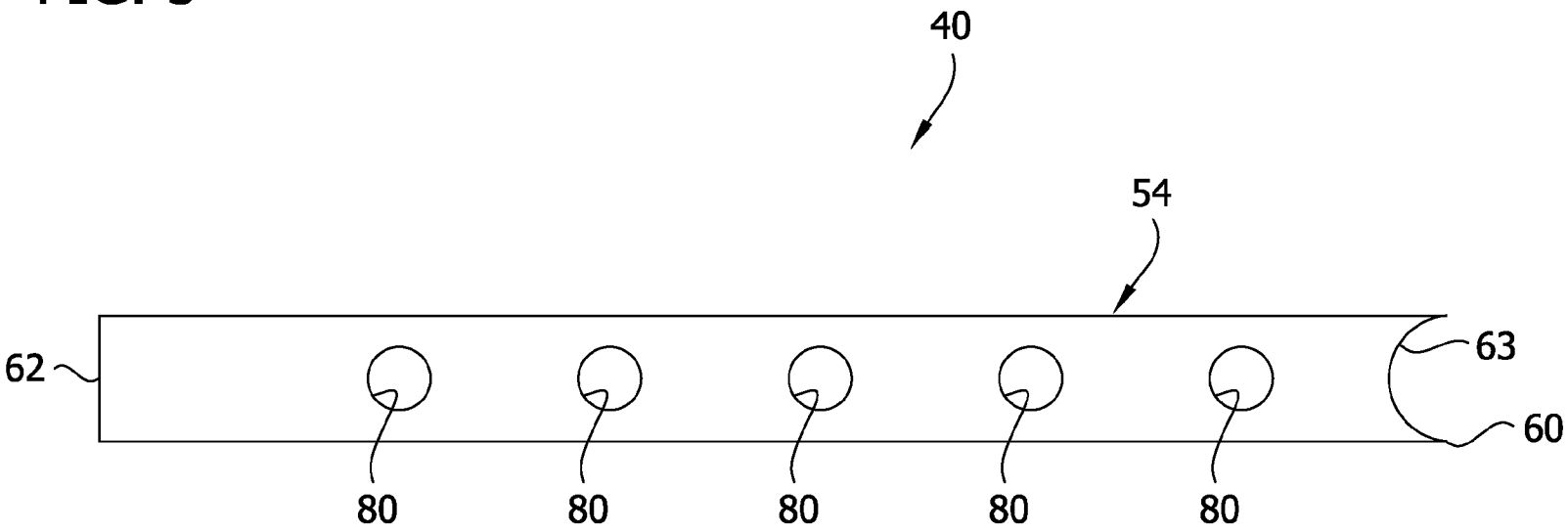
FIG. 5 is a left side elevation of the wall anchor, the right side elevation being identical thereto.

The wall anchor 40 includes a receptor 64 configured to receive a veneer tie 44. The receptor 64 is positioned adjacent the second open end 62. The receptor 64 is positioned in the cavity 22 when the wall anchor 40 is attached to the wall reinforcement 46. The receptor 64 includes openings 66, 68 extending through the wall 56 (FIG. 3). The openings 66, 68 are aligned with each other. Each opening 66, 68 extends through the wall 56 to the hollow interior 58. In the illustrated embodiment, where the hollow body 54 is generally cylindrical, the openings 66, 68 are diametrically opposed. However it will be understood that the hollow body 54, and in particular the wall 56, may have other configurations within the scope of the present invention. For example and without limitation, the wall may not completely enclose the hollow interior.

The receptor 64 is configured to receive an attachment portion of a veneer tie 44. For example, as illustrated in FIG. 1, the veneer tie 44 includes an attachment portion or pintle 70. The receptor 64 is positioned substantially vertically in the cavity 22 to receive the pintle 70. The pintle 70 extends through the receptor 64 (i.e., through the opening 66 and through the opening 68) to attach the veneer tie 44 to the wall anchor 40. In the illustrated embodiment, the pintle 70 is compressively reduced. The receptor 64 is generally rectangular to receive the compressively reduced pintle 70.

Referring still to FIG. 1, the veneer tie 44 includes a pair of pintles 70. A pair of wall anchors 40 is attached to the wall reinforcement 46, each of the wall anchors being configured to receive one of the pintles 70 in the respective receptor 64. As illustrated, pairs of wall anchors 40 are attached to the wall reinforcement 46 at spaced locations to permit connection with veneer ties 44 having pintles 70. Other configurations are within the scope of the present invention, such as the receptor 64 having a different shape to accommodate a different shape or size attachment portion of a veneer tie, or receptors positioned generally horizontally in the cavity to accommodate a different type of veneer tie.

At least one opening 80 extends through the wall 56 of the hollow body 54. In the illustrated embodiment, a plurality of openings 80 extend through the wall 56. The openings 80 reduce the mass of the wall anchor 40. The reduction in mass in the wall anchor 40 correspondingly reduces the amount of thermal transfer between the wall anchor and a veneer tie 44 attached to the wall anchor. In one embodiment, the total surface area of the wall 56 of the hollow body is reduced by an amount in a range of about 5% to about 95% by the openings 80 as compared to what the total surface area of the wall would be if the hollow body did not include any openings. In one embodiment, the total surface area of the wall 56 is reduced by an amount in a range of about 5% to about 75%, such as by 5%, by 10%, by 20%, by 25%, by 30%, by 35%, or by any other suitable amount. As illustrated, the wall anchor 40 includes openings 80 spaced along the length of the hollow body 54. The openings 80 are uniformly spaced along the length of the hollow body 54. The openings 80 are uniformly spaced around a circumference of the hollow body 54. Each opening 80 extends through the wall 56 to the hollow interior 58. Each opening 80 aligns with a corresponding diametrically opposed opening 80. In the illustrated embodiment, the wall anchor 40 includes twenty openings 80 uniformly spaced along the length of the hollow body 54 and around the circumference of the hollow body. Each opening 80 is generally circular. Each opening 80 is generally the same size. Other opening configurations and arrangements are within the scope of the present invention. For example, the openings 80 may not be arranged to be uniformly spaced along the length and/or around the circumference of the hollow body 54. The wall anchor 40 can include more openings 80 than illustrated, or fewer openings than illustrated. The openings 80 can have other shapes or configurations, or may have varying shapes, sizes, spacing, and configurations.

Figure 7:
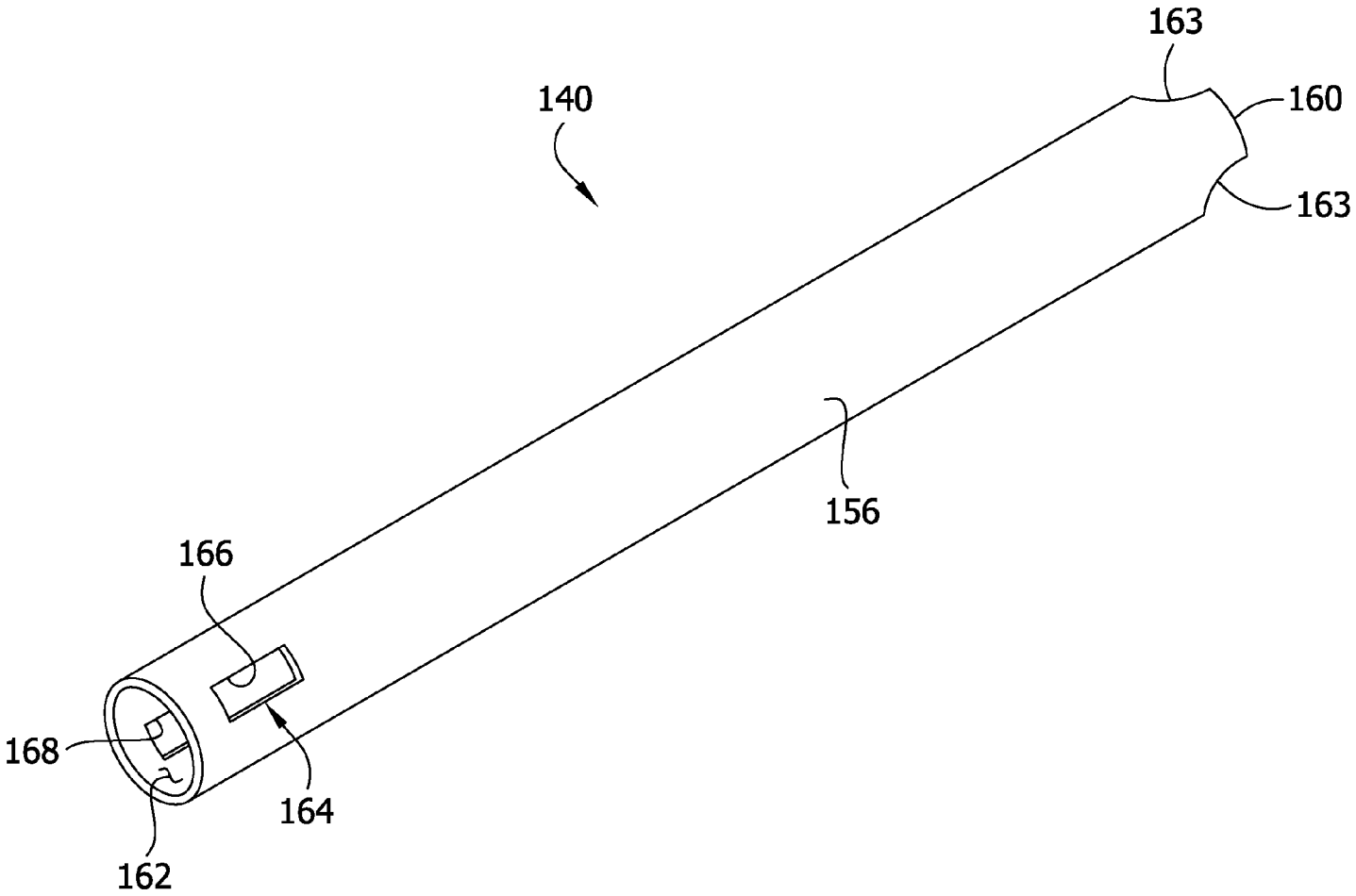
FIG. 7 is a rear perspective of a second embodiment of a wall anchor of the anchoring system.

Referring to FIG. 7, a second embodiment of a wall anchor is shown generally at 140. The wall anchor 140 is similar to the wall anchor 40, with differences pointed out herein. The wall anchor 140 is configured for attachment to the wall reinforcement 46 as described above with reference to wall anchor 40. A hollow body 154 of the wall anchor 140 is generally cylindrical and includes a wall 156 defining a hollow interior of the hollow body. In one embodiment, the hollow interior can be filled with insulation or a thermally insulating material (not shown). The wall 156 extends from a first open end 160 to a second open end 162. The first open end 160 is configured for attachment to the wall reinforcement 46 as described above with reference to the first open end 60 of the wall anchor 40. Particularly, the first open end 160 is cut back on its sides to form semi-circular recesses 163 for receiving the side wire member 48. The wall anchor 140 includes a receptor 164 configured to receive a veneer tie (not shown), such as the veneer tie 44 described above with reference to wall anchor 40. The receptor 164 is positioned adjacent the second open end 162. The receptor 164 includes openings 166, 168 extending through the wall 156. The receptor 164 is configured to receive the attachment portion or pintle 70 of the veneer tie.

In this embodiment, the hollow body 154 does not include additional openings extending through the wall 156. The hollow body 154 of the wall anchor 140 reduces the amount of thermal transfer between the wall anchor and a veneer tie 44 attached to the wall anchor.

Figure 8:
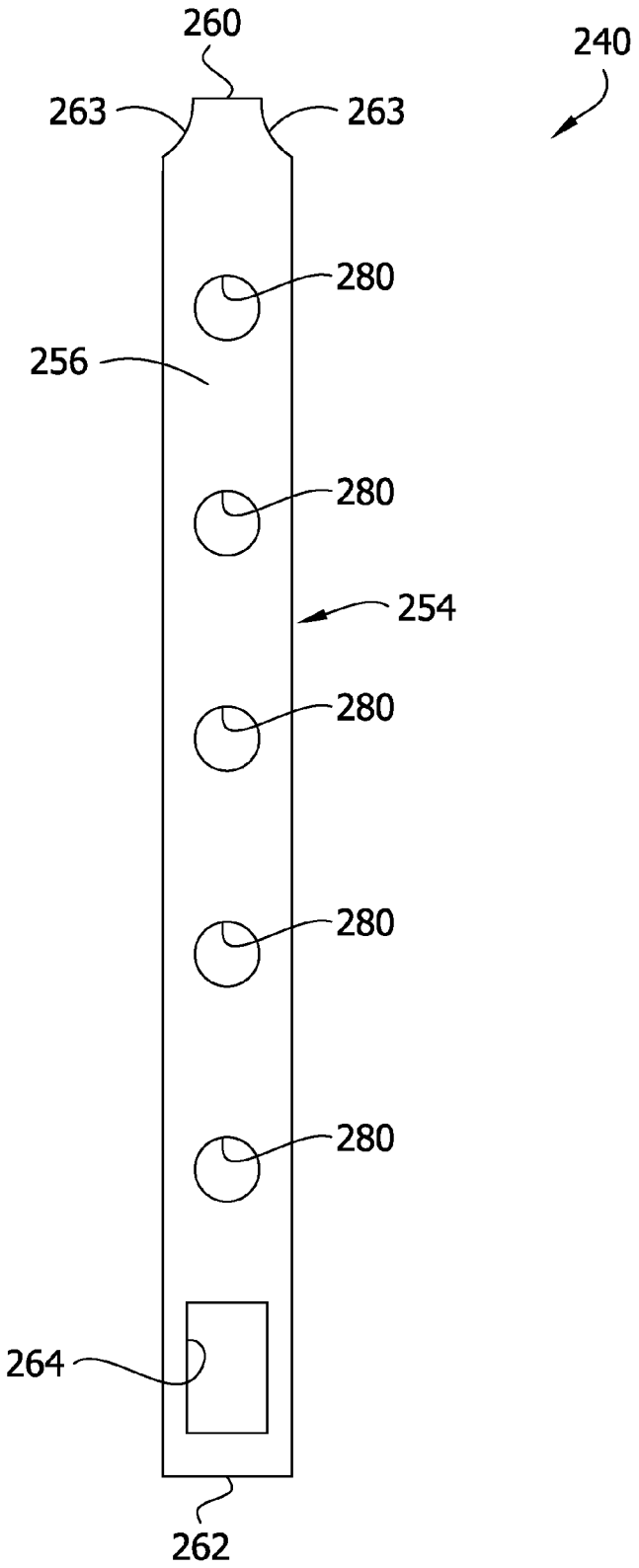
FIG. 8 is a top view of a third embodiment of a wall anchor for use with the anchoring system, the bottom view being identical thereto.

Referring to FIG. 8, a third embodiment of a wall anchor is shown generally at 240. The wall anchor 240 is similar to the wall anchor 40, with differences pointed out herein. The wall anchor 240 is configured for attachment to the wall reinforcement 46 as described above with reference to wall anchor 40. A hollow body 254 of the wall anchor 240 is generally cylindrical and includes a wall 256 defining a hollow interior of the hollow body (not shown). In one embodiment, the hollow interior can be filled with insulation or a thermally insulating material (not shown). The wall 256 extends from a first open end 260 to a second open end 262. The first open end 260 is configured for attachment to the wall reinforcement 46 as described above with reference to the first open end 60 of the wall anchor 40. Particularly, the first open end 260 is cut back on its sides to form semi-circular recesses 263 for receiving the side wire member 48. Openings 280 extend through the wall 256 of the hollow body 254. The openings 280 reduce the mass of the wall anchor 240 and reduce the amount of thermal transfer between the wall anchor and a veneer tie attached to the wall anchor, as discussed above with reference to the wall anchor 40.

The wall anchor 240 includes a receptor 264 configured to receive a veneer tie. The receptor 264 is positioned adjacent the second open end 262. The receptor 264 includes openings extending through the wall 256. The receptor 264 is configured to receive an attachment portion of a veneer tie, such as a pintle. The receptor 264 is generally rectangular. In this embodiment, the receptor 264 is relatively larger than the receptor 64 of wall anchor 40. This configuration permits attachment to a veneer tie having relatively larger pintles than the veneer tie 44 illustrated in FIG. 1.

Figure 9:
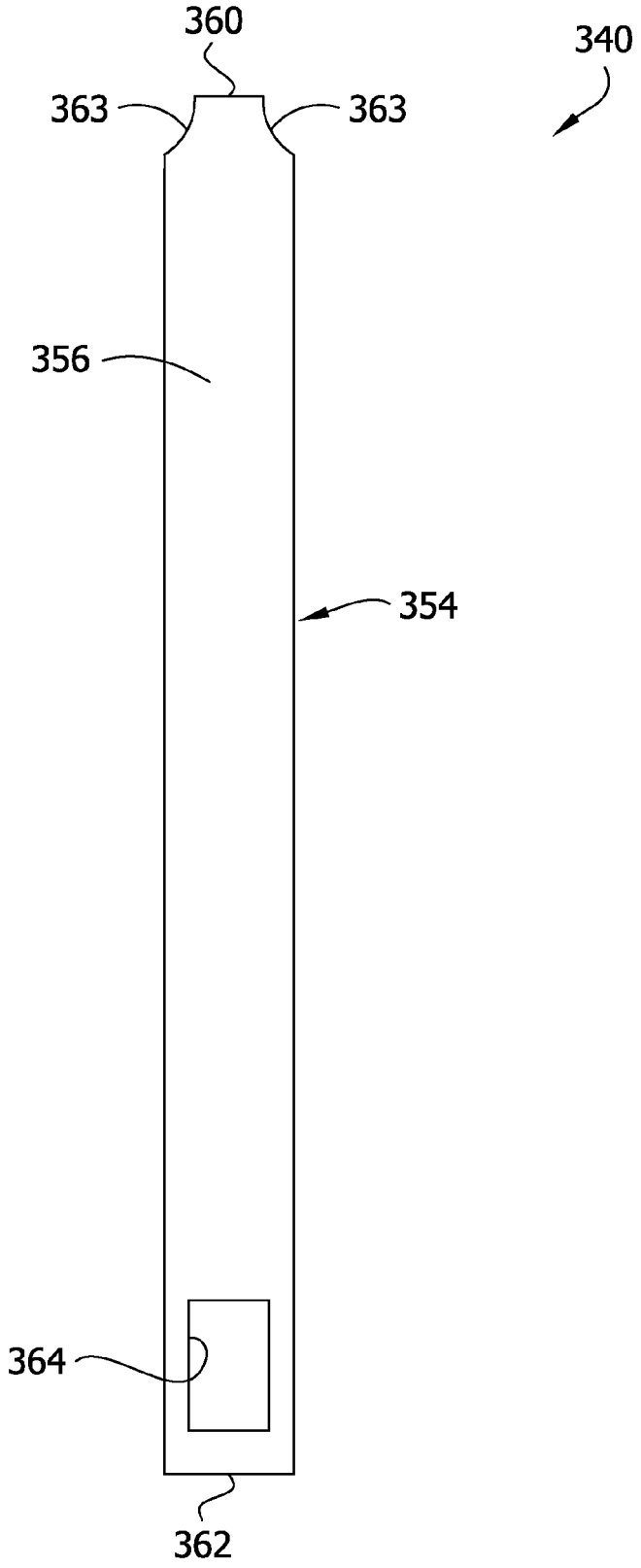
FIG. 9 is a top view of a fourth embodiment of a wall anchor for use with the anchoring system, the bottom view being identical thereto.

Referring to FIG. 9, a fourth embodiment of a wall anchor is shown generally at 340. The wall anchor 340 is similar to the wall anchor 240 described above. In this embodiment, the hollow body 354 does not include additional openings extending through the wall 356. The only openings extending through the hollow body 354 are the openings defining the receptor 364. The hollow body 354 of the wall anchor 340 reduces the amount of thermal transfer between the wall anchor and a veneer tie attached to the wall anchor. In one embodiment, the hollow interior can be filled with insulation or a thermally insulating material (not shown).

Referring to FIG. 10, an embodiment of an anchoring system for cavity walls is shown generally at 410. The anchoring system 410 includes the wire reinforcement 46 as described above. A wall anchor 440 extends into the cavity 22 and is attached to the wall reinforcement 446 in a suitable manner, such as by welding. It is also contemplated that the wall anchor could be formed as one piece with the reinforcement. As described in greater detail below, the wall anchor 440 is constructed and configured to reduce thermal transfer between the wall anchor and a veneer tie 444 attached to the wall anchor.

At intervals along the wall reinforcement 46, wall anchors 440 extend from the wall reinforcement and into the cavity 22. Each wall anchor 440 includes a receptor portion for receiving the veneer tie 444, as described in further detail below. The wall anchor 440 and the wall reinforcement 46 can be made of any suitable material. In one embodiment, the wall anchor 440 is made of stainless steel. In one embodiment, the wall reinforcement 46 is made of stainless steel. Other materials, such as galvanized steel, aluminum, or plastic, are within the scope of the present invention. The wall anchor 440 and the wall reinforcement 46 can be made of the same material or can be made of different materials.

Figure 11:
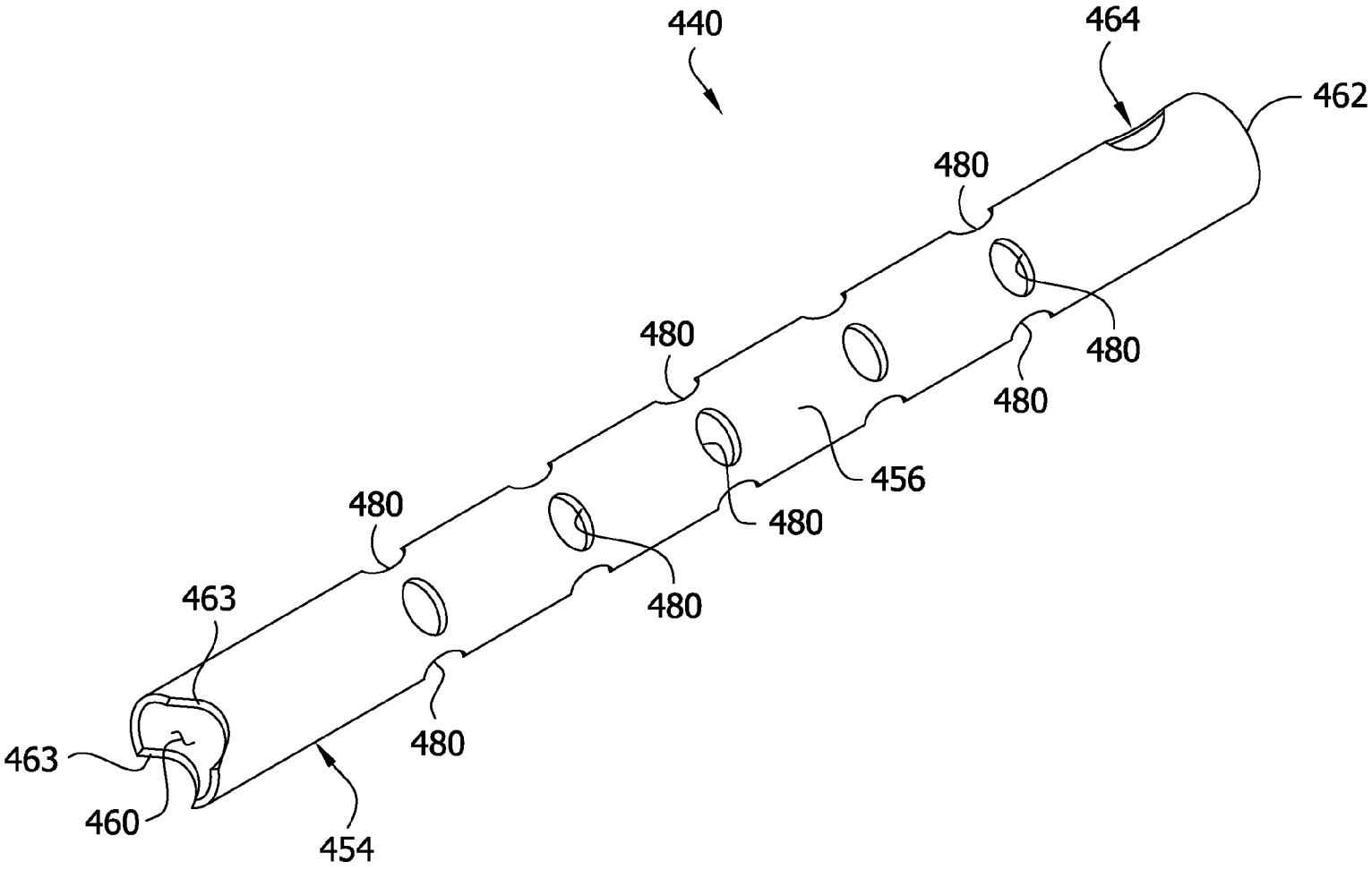
FIG. 11 is a front perspective of a wall anchor of the anchoring system of FIG. 10.
Figure 15:
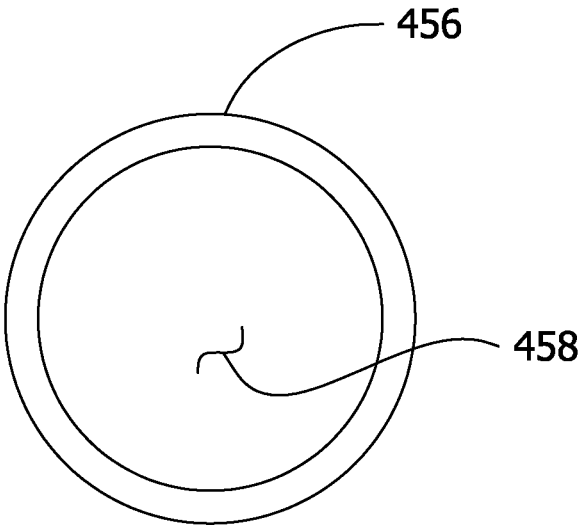
FIG. 15 is a front view of the wall anchor.

Referring to FIGS. 11-15, the wall anchor 440 includes a hollow body 454. In the illustrated embodiment, the hollow body 454 is generally cylindrical, although other shapes (e.g., rectangular) are within the scope of the present invention. The hollow body 454 includes a wall 456 defining a hollow interior 458 of the hollow body (FIG. 15). In one embodiment, the hollow interior 458 can be filled with insulation or a thermally insulating material (not shown). The wall 456 extends from a first open end 460 to a second open end 462 of the hollow body 454. The first open end 460 is configured for attachment to the wall reinforcement 46 in a suitable manner. In the illustrated embodiments, the first open end 460 is welded to the side wire member 48 and the intermediate wire 52 (FIG. 10), but could be welded just to the side wire member. When the first open end 460 is attached to the wall reinforcement 46, the second open end 462 extends into the cavity 22. The first open end 460 is cut back on its sides to form semi-circular recesses 463 for receiving the side wire member 48. As illustrated in FIG. 11, the first open end 460 includes two semi-circular recesses 463. The recesses 463 provide for a more nearly conformal engagement with the round side wire member 48, thereby enhancing the weld connection between the wall anchor 440 and the wall reinforcement 46. It is understood that other configurations are within the scope of the present invention. For example, the first end 460, the second end 462, or both the first and second ends of the hollow body 454 may be closed ends. In one embodiment, the first open end can include additional recesses (e.g., four recesses, see FIGS. 17 and 18).

Figure 12:
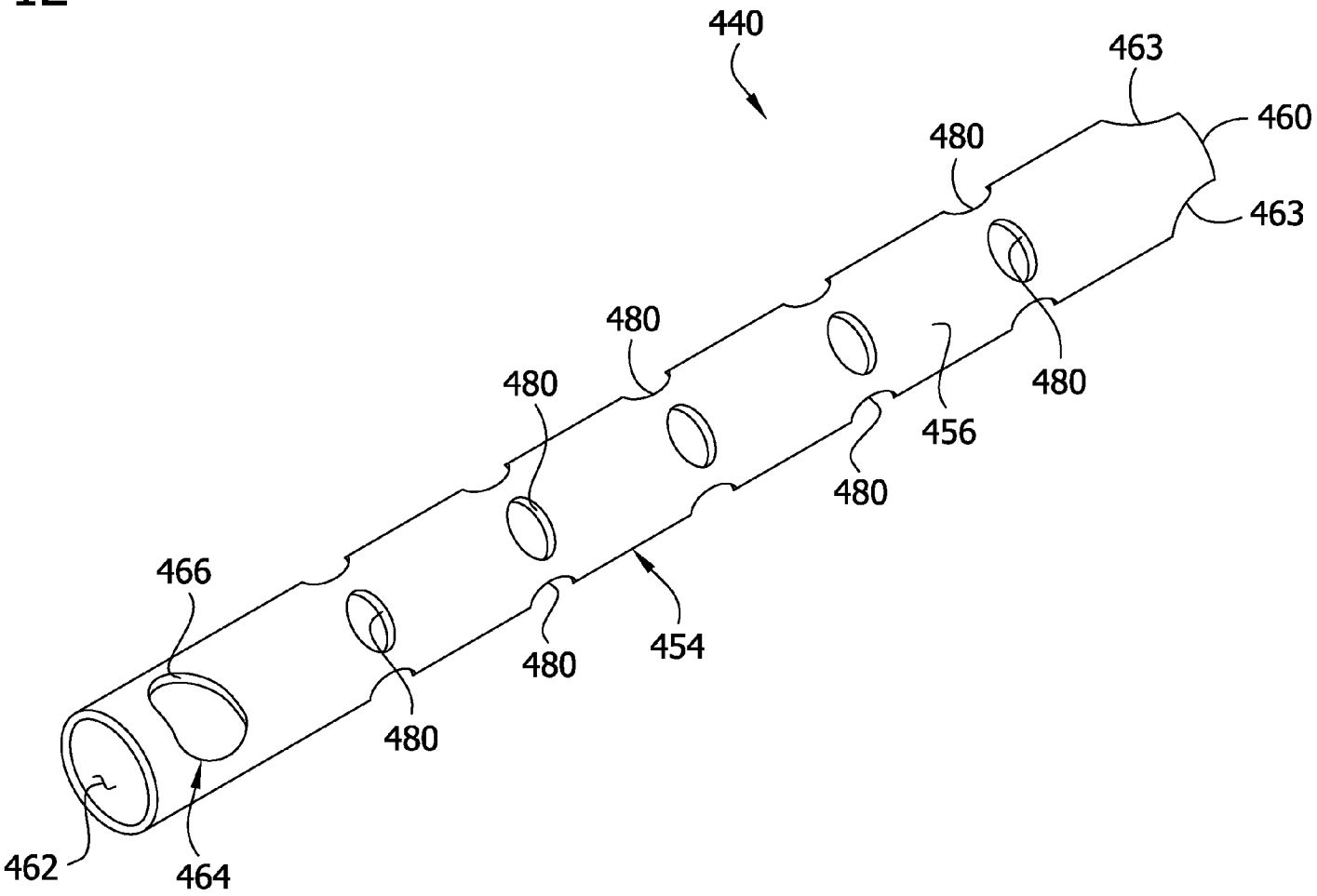
FIG. 12 is a rear perspective thereof.
Figure 13:
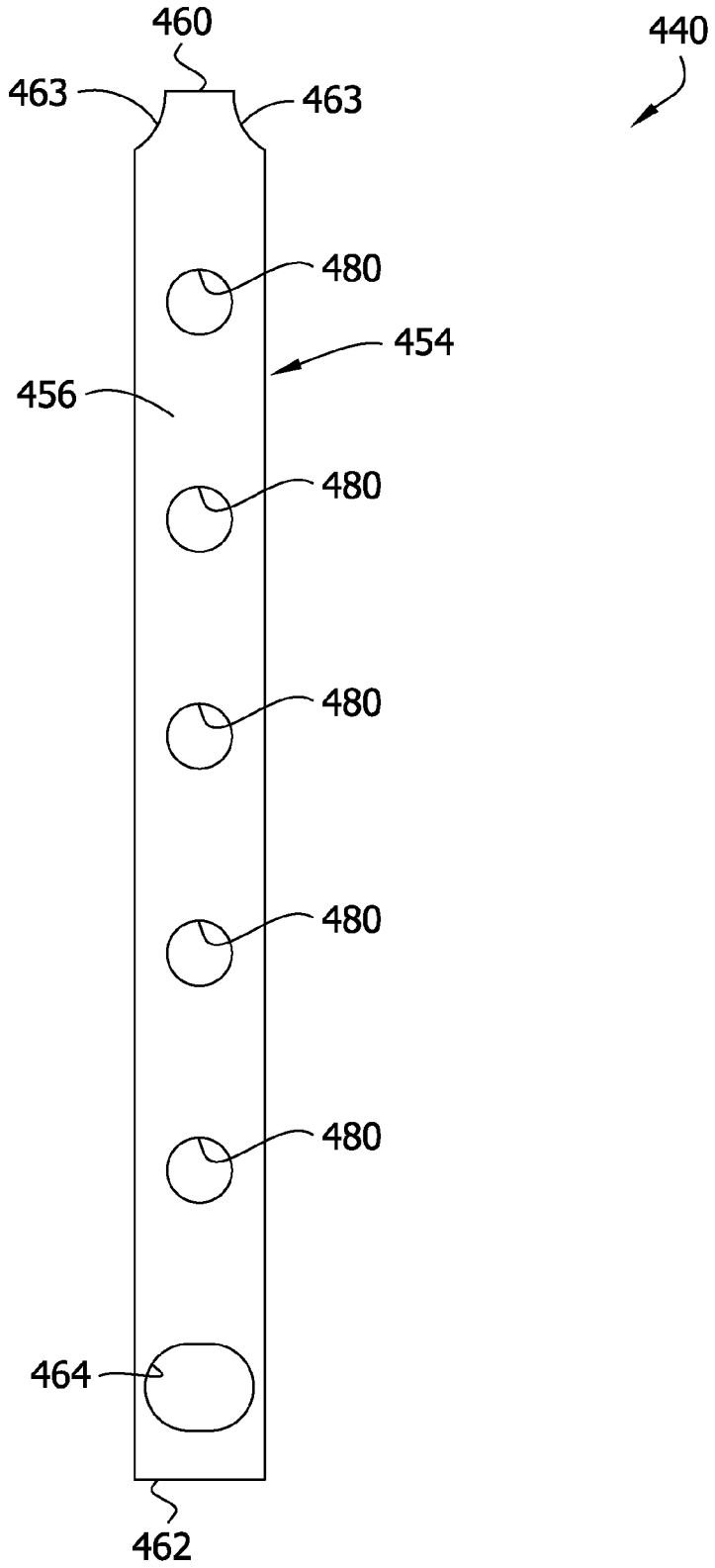
FIG. 13 is a top view of the wall anchor, the bottom view being identical thereto.
Figure 14:
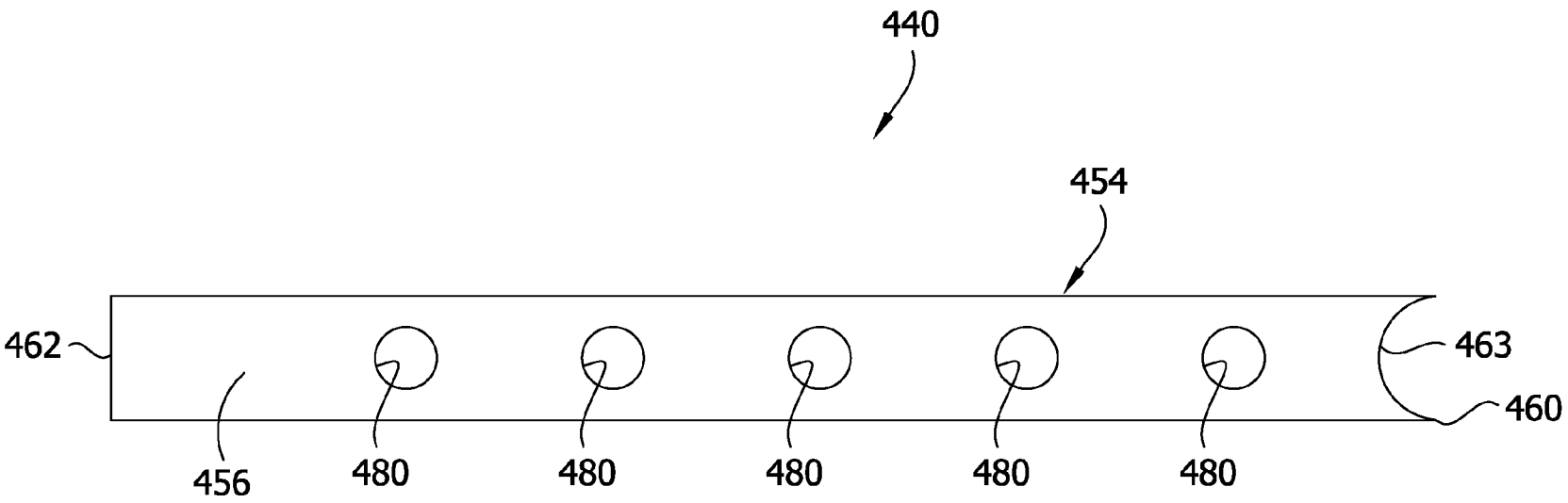
FIG. 14 is a left side elevation of the wall anchor, the right side elevation being identical thereto.

The wall anchor 440 includes a receptor 464 configured to receive a veneer tie 444. The receptor 464 is positioned adjacent the second open end 462. The receptor 464 is positioned in the cavity 22 when the wall anchor 440 is attached to the wall reinforcement 46. The receptor 464 includes openings 466, 468 extending through the wall 456 (FIG. 12). The openings 466, 468 are aligned with each other. Each opening 466, 468 extends through the wall 456 to the hollow interior 458. In the illustrated embodiment, where the hollow body 454 is generally cylindrical, the openings 466, 468 are diametrically opposed.

The receptor 464 is configured to receive an attachment portion of a veneer tie 444. For example, as illustrated in FIG. 10, the veneer tie 444 includes an attachment portion or U-shaped rear leg portion 478. The receptor 464 is positioned substantially vertically in the cavity 22 to receive the U-shaped rear leg portion 478. The U-shaped rear leg portion 478 extends through the receptor 464 (i.e., through the opening 466 and through the opening 468) to attach the veneer tie 444 to the wall anchor 440. The receptor 464 is generally oblong to receive the U-shaped rear leg portion 478. The receptor 464 is generally longer in a direction extending parallel to the inner wythe 14 when the wall anchor 440 is positioned in the cavity 22 (i.e., in a direction generally transverse to a longitudinal axis of the hollow body 454). This elongation of the receptor 464 facilitates threading the veneer tie 444 to position the U-shaped rear leg portion 478 relative to the wall anchor 440. Referring still to FIG. 10, spaced wall anchors 440 are attached to the wall reinforcement 46, each of the wall anchors being configured to receive one of the U-shaped rear leg portions 478 in the respective receptor 464. Other configurations are within the scope of the present invention, such as the receptor 464 having a different shape to accommodate a different shape or size attachment portion of a veneer tie, or receptors positioned generally horizontally in the cavity to accommodate a different type of veneer tie.

At least one opening 480 extends through the wall 456 of the hollow body 454. In the illustrated embodiment, a plurality of openings 480 extend through the wall 456. The openings 480 reduce the mass of the wall anchor 440. The reduction in mass in the wall anchor 440 correspondingly reduces the amount of thermal transfer between the wall anchor and a veneer tie 444 attached to the wall anchor. In one embodiment, the total surface area of the wall 456 of the hollow body 454 is reduced by an amount in a range of about 5% to about 95% by the openings 480 as compared to what the total surface area of the wall would be if the hollow body did not include any openings. In one embodiment, the total surface area of the wall 456 is reduced by an amount in a range of about 5% to about 75%, such as by 5%, by 10%, by 20%, by 25%, by 30%, by 35%, or by any other suitable amount. As illustrated, the wall anchor 440 includes openings 480 spaced along the length of the hollow body 454. The openings 480 are uniformly spaced along the length of the hollow body 454. The openings 480 are uniformly spaced around a circumference of the hollow body 454. Each opening 480 extends through the wall 456 to the hollow interior 458. Each opening 480 aligns with a corresponding diametrically opposed opening 480. In the illustrated embodiment, the wall anchor 440 includes twenty openings 480 uniformly spaced along the length of the hollow body 454 and around the circumference of the hollow body. Each opening 480 is generally circular. Each opening 480 is generally the same size. Other opening configurations and arrangements are within the scope of the present invention. For example, the openings 480 may not be arranged to be uniformly spaced along the length and/or around the circumference of the hollow body 454. The wall anchor 440 can include more openings 480 than illustrated, or fewer openings 480 than illustrated. The openings 480 can have other shapes or configurations, or may have varying shapes, sizes, spacing, and configurations.

Figure 16:
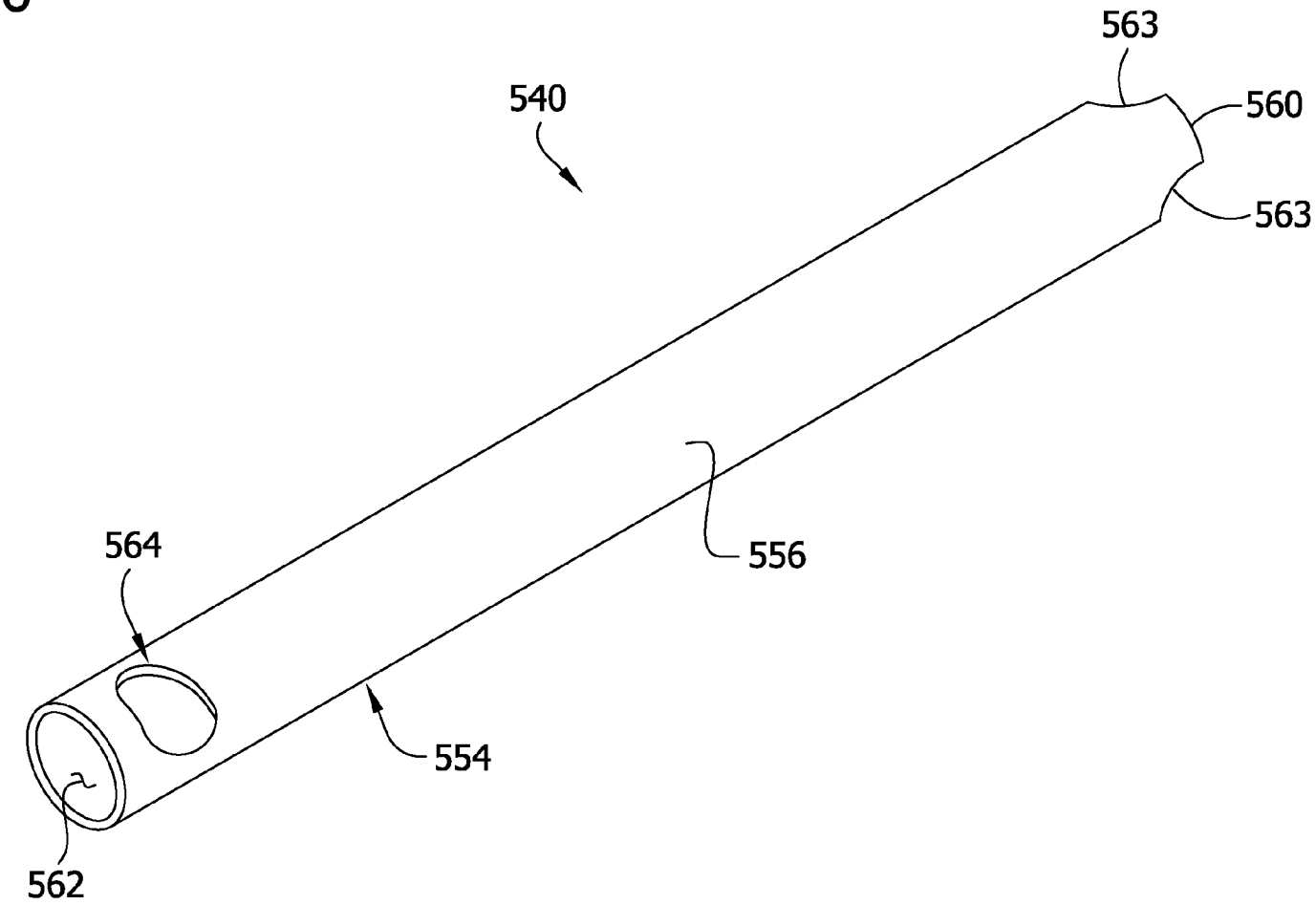
FIG. 16 is a rear perspective of another embodiment of a wall anchor of the anchoring system of FIG. 10.

Referring to FIG. 16, another embodiment of a wall anchor is shown generally at 540. The wall anchor 540 is similar to the wall anchor 440, with differences pointed out herein. The wall anchor 540 is configured for attachment to the wall reinforcement 46 as described above with reference to wall anchor 440. A hollow body 554 of the wall anchor 540 is generally cylindrical and includes a wall 556 defining a hollow interior of the hollow body. In one embodiment, the hollow interior can be filled with insulation or a thermally insulating material (not shown). The wall 556 extends from a first open end 560 to a second open end 562. The first open end 560 is configured for attachment to the wall reinforcement 46 as described above with reference to the first open end 460 of the wall anchor 440. Particularly, the first open end 560 is cut back on its sides to form semi-circular recesses 563 for receiving the side wire member 448. The wall anchor 540 includes a receptor 564 configured to receive a veneer tie 444, as described above with reference to wall anchor 440. The receptor 564 is positioned adjacent the second open end 562 and includes openings extending through the wall 556. The receptor 564 is configured to receive the attachment portion or U-shaped rear leg portion 478 of the veneer tie 444. The receptor 564 is generally oblong with a longest dimension extending generally transverse to a longitudinal axis of the hollow body 554, as described above with reference to the receptor 464 of the wall anchor 440.

In this embodiment, the hollow body 554 does not include additional openings extending through the wall 556. The hollow body 554 of the wall anchor 540 reduces the amount of thermal transfer between the wall anchor and a veneer tie 444 attached to the wall anchor.

Figure 17:
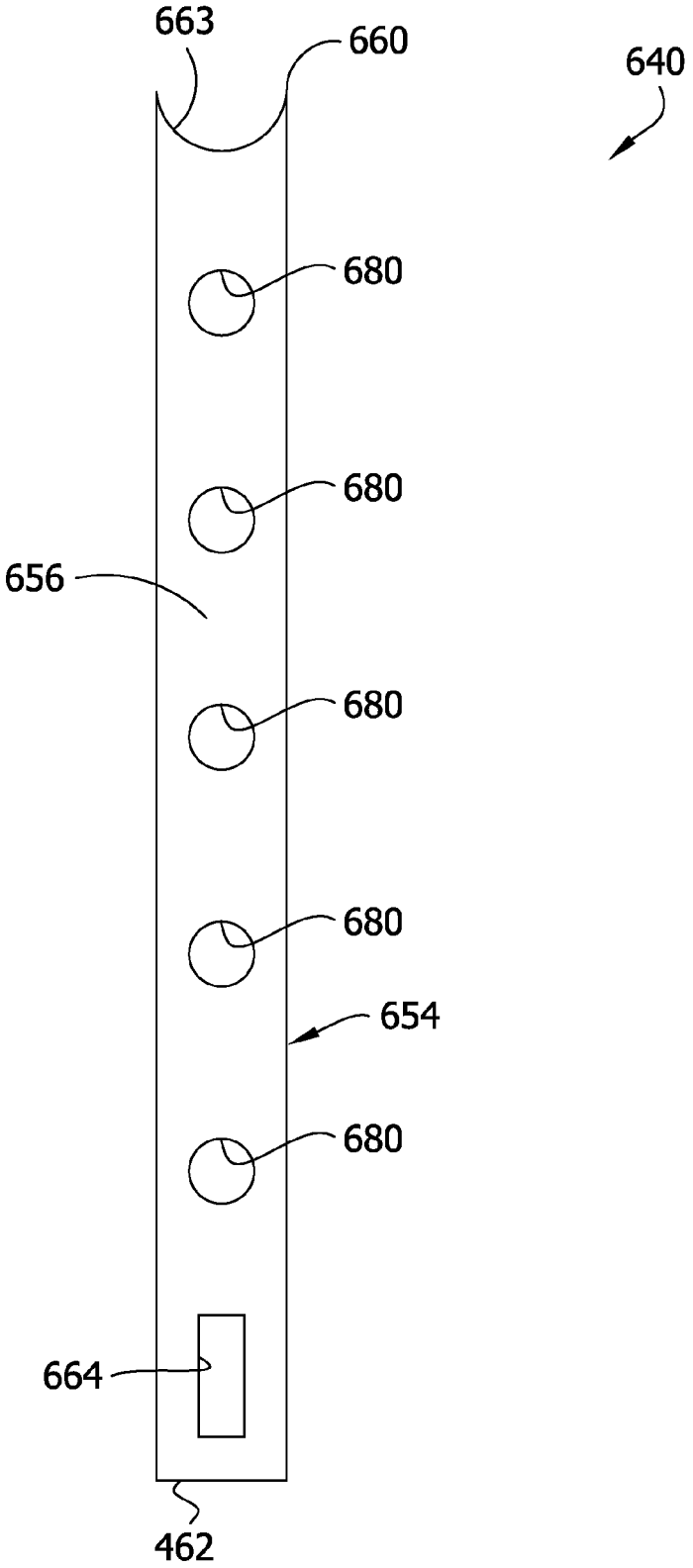
FIG. 17 is a top view of yet another embodiment of a wall anchor, the bottom view being identical thereto.
Figure 18:
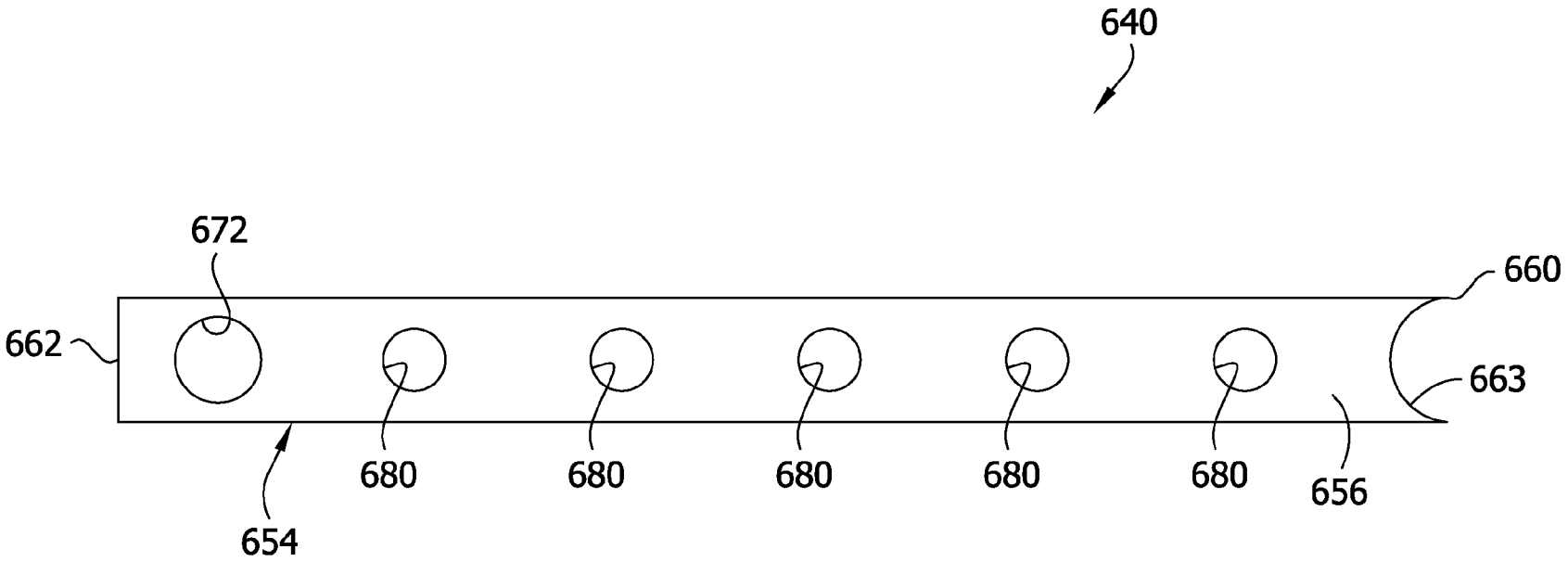
FIG. 18 is a left side elevation of the wall anchor of FIG. 17, the right side elevation being identical thereto.

Referring to FIGS. 17 and 18, another embodiment of a wall anchor is shown generally at 640. The wall anchor 640 is similar to the wall anchors 40 and 440, with differences pointed out herein. The wall anchor 640 is configured for attachment to two different types of veneer ties 44, 444. The wall anchor 640 includes a first receptor 664 (FIG. 17) that is similar to the receptor 64 described above. The first receptor 664 is configured to receive a pintle 70 of a veneer tie 44. The wall anchor 640 further includes a second receptor 672 (FIG. 18). The second receptor 672 is similar to the receptor 464 described above. The second receptor 672 is configured to receive a U-shaped rear leg portion 478 of the veneer tie 444. As illustrated, the first open end 640 includes four recesses 663. The first and second receptors 664, 672 and the four recesses 663 permit the wall anchor 640 to be attached to a side wire 48 in different orientations, depending on the requirements of the anchoring system. The wall anchor 640 includes openings 680, although the openings can be omitted within the scope of the present invention.

Referring to the embodiment in FIG. 1, pairs of wall anchors 40 are attached to the wall reinforcement 46 at spaced locations. This configuration of wall anchors 40 permits connection with the veneer tie 44 having pintles 70. Referring to the embodiment of FIG. 10, individual wall anchors 440 are attached to the wall reinforcement 46 at spaced locations. This configuration of wall anchors 440 permits connection to a veneer tie 444 having a single rear leg attachment portion 478. It is understood that the wall anchor can be configured for connection to other types of veneer ties. The insertion portion of the veneer tie can be swaged (FIG. 10) to receive a wire reinforcement (not shown), as is known in the art. Optionally, the insertion portion of the veneer tie can be compressively reduced in height (not shown). Portions of the veneer tie and/or portions of the wall anchor can include a thermal coating configured to provide a thermal break in the cavity 22 (not shown). For example, at least the attachment portion of the veneer tie and/or at least the receptor of the wall anchor can include a thermal coating to provide a thermal break in the cavity.

The wall anchors and anchoring systems as described above reduces the thermal transfer in the cavity wall structure 12. The wall anchors as described have a smaller mass than a typical wire formative wall anchor. Due to the smaller mass of the wall anchor, there is less thermal transfer between the wall anchor and a veneer tie 44, 444 attached to the wall anchor.

Figure 19:
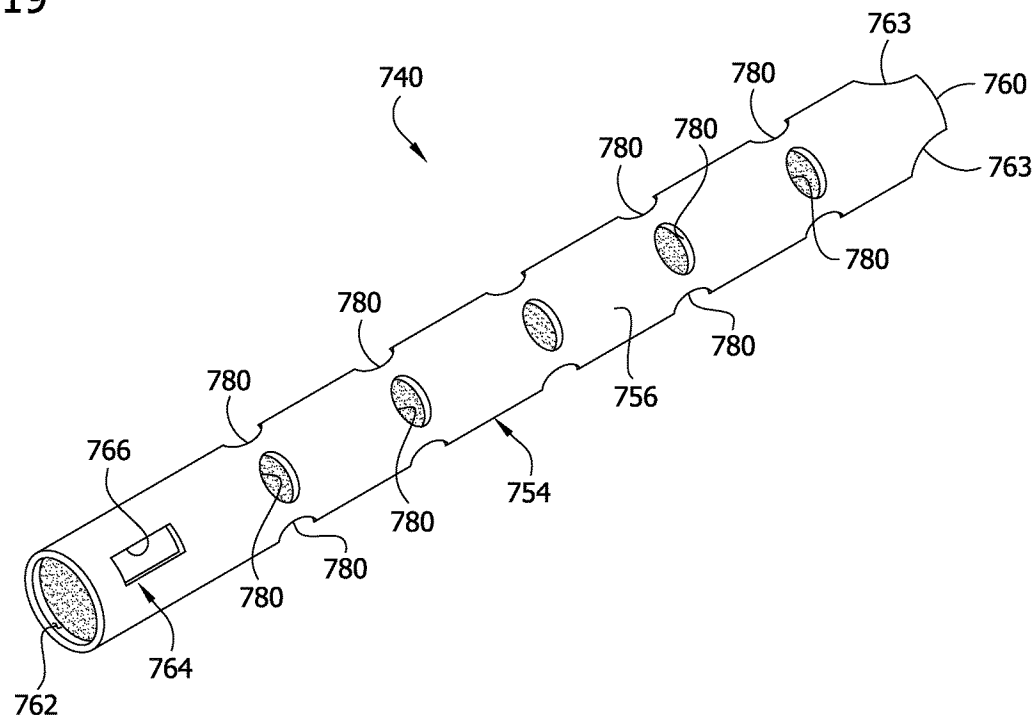
FIG. 19 is a perspective of the wall anchor of FIG. 3, but showing thermally insulating material within the wall anchor.
Figure 20:
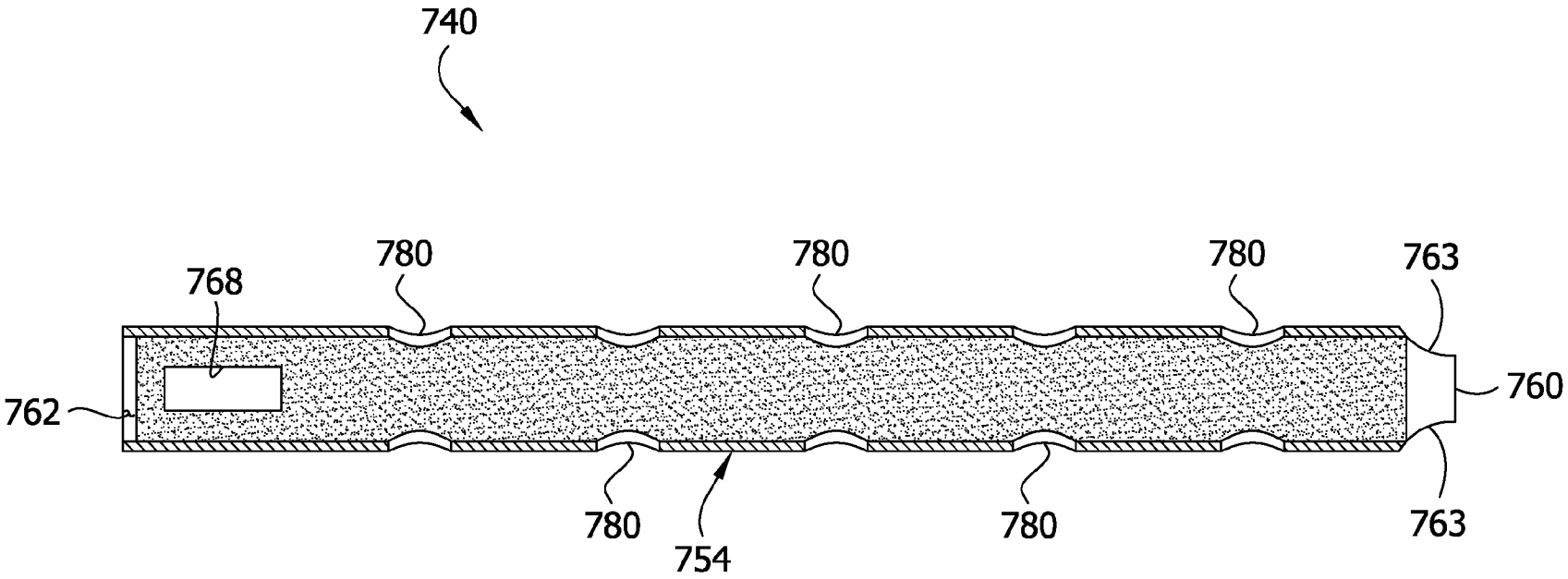
FIG. 20 is a longitudinal section of the wall anchor of FIG. 19.

Referring to FIGS. 19 and 20, a wall anchor 740 has the substantially identical construction of wall anchor 40, but is shown filled with insulation or a thermally insulating material 784. Parts of the wall anchor 740 corresponding to the wall anchor 40 are given the same reference numeral, plus "700". As may be seen, the thermally insulating material 784 fills the hollow interior of the hollow body 756. The thermally insulating material 784 extends from just short of the opening 760 at one end of the hollow body 754 to near the opening 762 at the opposite end of the hollow body. The thermally insulating material 784 has an opening 786 that aligned with the receptor openings 766, 768 for receiving a pintle of a veneer tie (not shown).

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A wall anchor configured for use in a cavity wall to connect to a veneer tie to join an inner wythe and an outer wythe of the cavity wall, the wall anchor comprising a hollow body having a wall defining a hollow interior, the hollow body including a receptor located on the hollow body wall and configured to connect to an attachment portion of a veneer tie in a relation so as to transmit forces between the inner wythe and the outer wythe, wherein the wall anchor comprises a plurality of openings extending through the hollow body wall into the hollow interior, the openings being spaced apart over the hollow body wall and reducing a total surface area of the hollow body wall by an amount in a range of about 10% to about 95%.

2. The wall anchor of claim 1, wherein the receptor comprises an opening extending through the hollow body wall to the hollow interior.

3. The wall anchor of claim 1, wherein the plurality of openings are uniformly spaced along a length of the hollow body.

4. The wall anchor of claim 1, wherein the plurality of openings are uniformly spaced around a circumference of the hollow body.

5. The wall anchor of claim 1, further comprising thermally insulating material disposed within the hollow interior of the body, the thermally insulating material having an opening therein aligned with the receptor.

6. The wall anchor of claim 1, wherein the hollow body is tubular and extends from a first open end configured for attachment to a wall reinforcement to a second open end configured to extend into a cavity of the cavity wall, the receptor being positioned adjacent the second open end of the hollow body.

7. The wall anchor of claim 6, wherein the first open end of the hollow body includes at least one recess configured to receive a side wire of the wall reinforcement.

8. An anchoring system for use in a cavity wall having an inner wythe and an outer wythe spaced from the inner wythe and forming a cavity therebetween, the anchoring system comprising:

a wall reinforcement configured to be received in the inner wythe, the wall reinforcement comprising first and second parallel side wires and at least one intermediate wire extending between the first and second side wires; and a wall anchor attached to at least one of the first side wire and the intermediate wire, the wall anchor comprising a hollow body having a wall defining a hollow interior, the hollow body extending from a first end attached to the wall reinforcement to a second end configured to extend into the cavity of the cavity wall, the hollow body including a receptor located on the hollow body wall adjacent the second end and configured to receive an attachment portion of a veneer tie in a relation so as to transmit forces between the inner wythe and the outer wythe, wherein the wall anchor comprises a plurality of openings extending through the hollow body wall into the hollow interior, the openings being spaced apart over the hollow body wall and reducing a total surface area of the hollow body wall by an amount in a range of about 10% to about 95%.

9. The anchoring system of claim 8, wherein the receptor comprises an opening extending through the hollow body wall to the hollow interior.

10. The anchoring system of claim 8, wherein the plurality of openings are spaced from the receptor such that at least one opening of the plurality is closer to the first end of the hollow body than the receptor.

11. The anchoring system of claim 8, wherein the plurality of openings are uniformly spaced along a length of the hollow body.

12. The anchoring system of claim 8, wherein the plurality of openings are uniformly spaced around a circumference of the hollow body.

13. The anchoring system of claim 8, further comprising thermally insulating material disposed within the hollow interior of the body, the thermally insulating material having an opening therein aligned with the receptor.

14. The anchoring system of claim 8, wherein the first end of the hollow body includes at least one recess configured to receive one of the side wires of the wall reinforcement.

15. The anchoring system of claim 8, in combination with the veneer tie having the attachment portion configured to be received in the receptor of the wall anchor.

* * * * *